US010874193B2

(12) United States Patent
Chen et al.

(10) Patent No.: US 10,874,193 B2
(45) Date of Patent: Dec. 29, 2020

(54) WHEEL ACTUATED COSMETIC STICK

(71) Applicant: HCT GROUP HOLDINGS LIMITED, Sheung Wan (CN)

(72) Inventors: Samuel Kai-Der Chen, Los Angeles, CA (US); Nolan Quentin Eng, Foothill Ranch, CA (US); Ryan L. Gleason, Santa Monica, CA (US); Adrian Charles Apodaca, Daly City, CA (US); Armando Villarreal, Los Angeles, CA (US); Lewis On Hang Lee, Encino, CA (US)

(73) Assignee: HCT GROUP HOLDINGS LIMITED, Hong Kong (CN)

( * ) Notice: Subject to any disclaimer, the term of this patent is extended or adjusted under 35 U.S.C. 154(b) by 0 days.

(21) Appl. No.: 16/298,911

(22) Filed: Mar. 11, 2019

(65) Prior Publication Data

US 2019/0281954 A1 Sep. 19, 2019

Related U.S. Application Data

(60) Provisional application No. 62/642,744, filed on Mar. 14, 2018.

(51) Int. Cl.
*A45D 40/20* (2006.01)
*A45D 40/04* (2006.01)
(Continued)

(52) U.S. Cl.
CPC ..... *A45D 40/205* (2013.01); *A45D 40/04* (2013.01); *A45D 40/06* (2013.01); *A45D 40/12* (2013.01); *A45D 2040/208* (2013.01)

(58) Field of Classification Search
CPC ..... A45D 40/00; A45D 40/205; A45D 40/04; A45D 40/06; A45D 40/02; A45D 40/12;
(Continued)

(56) References Cited

U.S. PATENT DOCUMENTS 544,452 A 8/1895 Young et al.
753,968 A 3/1904 Farmer
(Continued)

FOREIGN PATENT DOCUMENTS

CN 2606543 Y 3/2004
CN 200941885 Y 9/2007
(Continued)

OTHER PUBLICATIONS

International Search Report and Written Opinion dated Jun. 26, 2019 for International Application No. PCT/US2019/021677.
(Continued)

*Primary Examiner* — David J Walczak
(74) *Attorney, Agent, or Firm* — Seager, Tufte & Wickhem LLP

(57) ABSTRACT

A cosmetic application device may include a housing having an opening on a top surface, an inner tube disposed within the housing, and a wheel actuator disposed on a side surface of the housing and rotatably coupled to the inner tube. The inner tube may be configured for holding a cosmetic product stick. Rotation of the wheel actuator may cause the cosmetic product stick to move axially through the housing and out of the opening.

20 Claims, 8 Drawing Sheets

(51) Int. Cl.
*A45D 40/06* (2006.01)
*A45D 40/12* (2006.01)

(58) Field of Classification Search
CPC ..... A45D 40/20; A45D 2040/208; A45D 2040/204; A45D 2040/00; A45D 2040/012; A45D 2040/20; A45D 2040/205; F16H 1/203; F16H 1/00; F16H 1/12; F16H 1/04; B05C 17/01; B05C 17/0116
USPC ..... 401/75–79, 172–174
See application file for complete search history.

(56) References Cited

U.S. PATENT DOCUMENTS 776,468 A 11/1904 Hosmer
1,362,601 A 12/1920 Chandler
1,429,823 A 9/1922 Allison
1,666,116 A 4/1928 Bunnell
2,034,137 A 3/1936 Dermot
2,442,503 A 6/1948 Zachary
2,459,733 A 1/1949 Donald
2,512,100 A 6/1950 Leo
D165,691 S 1/1952 Macomic
2,584,735 A 2/1952 Pancoast
2,590,329 A 3/1952 Viva
2,982,987 A 5/1961 Knapp
3,028,868 A 4/1962 Tandler
3,130,433 A 4/1964 John
3,235,900 A 2/1966 Klassen
3,275,132 A * 9/1966 Hultgren ..... A45D 40/04 401/6
3,577,582 A 5/1971 Aston
3,837,749 A 9/1974 Spatz
3,850,183 A 11/1974 Gruska
3,908,676 A 9/1975 Levine et al.
3,951,157 A 4/1976 Idec
4,029,422 A 6/1977 Pillsbury
4,129,391 A 12/1978 Gamacher
4,291,685 A 9/1981 Taelman
4,446,880 A 5/1984 Gueret et al.
4,470,715 A 9/1984 Reuchlin et al.
D280,135 S 8/1985 Cassai et al.
4,545,393 A 10/1985 Gueret et al.
4,551,038 A 11/1985 Baker et al.
4,617,948 A 10/1986 Gueret
4,869,612 A 9/1989 Mooney et al.
4,874,117 A 10/1989 Kay et al.
4,880,326 A 11/1989 Spivey et al.
4,887,924 A 12/1989 Green
4,909,265 A 3/1990 Goncalves
D307,191 S 4/1990 Blutenthal
4,929,108 A 5/1990 Gueret
4,940,350 A 7/1990 Kim
4,987,911 A 1/1991 Powers
5,007,442 A 4/1991 Hirzel
5,052,839 A 10/1991 Pettengill
5,056,179 A 10/1991 Capponi
D325,264 S 4/1992 Shinohara
5,109,877 A 5/1992 Takeda
5,116,156 A 5/1992 Landi
D328,366 S 7/1992 Villani
5,180,244 A 1/1993 Hirose
D339,235 S 9/1993 Hirzel
5,302,043 A 4/1994 Velliquette
5,391,011 A 2/1995 Gueret
5,567,073 A 10/1996 Laforcade et al.
5,620,270 A 4/1997 Gueret
5,690,441 A 11/1997 McManus
5,738,067 A 4/1998 Landwehr et al.
5,816,728 A 10/1998 Nardolillo et al.
5,836,320 A 11/1998 Gueret
5,888,004 A * 3/1999 Bouix ..... A45D 40/04 401/68
5,960,802 A 10/1999 Sakai
6,009,887 A 1/2000 Hertel
6,010,264 A 1/2000 Scuderi et al.
6,026,824 A 2/2000 Gueret
6,035,865 A 3/2000 Krieger
D425,669 S 5/2000 Gavin
6,059,474 A 5/2000 Huang
6,126,352 A 10/2000 Wiley
6,129,469 A 10/2000 Messer et al.
6,164,857 A 12/2000 Wolfarth-Brooks et al.
6,238,117 B1 5/2001 Griebel et al.
6,261,014 B1 7/2001 Altobellis et al.
6,287,034 B1 9/2001 Miraglia et al.
6,290,416 B1 9/2001 Gueret
6,309,125 B1 10/2001 Peters
6,309,128 B1 10/2001 Griebel et al.
6,315,479 B1 11/2001 Sakurai
6,402,411 B2 6/2002 Spencer et al.
6,546,937 B2 4/2003 Gueret
6,588,958 B1 7/2003 Seidler
6,591,842 B2 7/2003 Gueret
6,607,323 B2 8/2003 Breidenbach et al.
6,648,538 B2 11/2003 Gueret
6,672,784 B2 1/2004 Baumann et al.
6,688,317 B2 2/2004 Gueret
6,866,046 B2 3/2005 Gueret
6,890,115 B2 5/2005 Moing
6,974,513 B2 12/2005 Kepka
7,040,827 B2 5/2006 Gueret
7,066,674 B2 6/2006 Gueret
7,083,347 B2 8/2006 Marcotte et al.
7,147,395 B2 12/2006 Weiss et al.
7,172,357 B2 2/2007 Gueret
7,261,483 B2 8/2007 Gueret
D555,831 S 11/2007 Chan
7,344,327 B2 3/2008 Gueret
7,398,898 B2 7/2008 Bouix et al.
7,416,358 B2 8/2008 Legendre
7,429,141 B2 9/2008 Habatjou
7,467,905 B2 12/2008 Habatjou
7,476,048 B2 1/2009 Prague
7,530,752 B2 5/2009 Gueret
7,581,544 B2 9/2009 Gueret
7,628,559 B2 12/2009 Petit
7,785,026 B2 8/2010 Eng et al.
7,824,124 B2 11/2010 Francavilla et al.
7,878,727 B2 2/2011 Koptis
7,883,287 B2 2/2011 Thorpe
7,927,032 B2 4/2011 Sanchez
7,942,596 B2 * 5/2011 Saunders ..... A45D 40/06 401/107
7,959,369 B2 6/2011 Gueret
8,028,707 B2 10/2011 Wyatt et al.
D653,805 S 2/2012 Tani
8,136,536 B2 3/2012 Bickford
8,141,561 B2 3/2012 Thorpe et al.
8,161,983 B1 4/2012 Lee
8,220,469 B1 7/2012 Spagnuolo
8,226,319 B2 7/2012 Francavilla et al.
8,251,074 B2 8/2012 Pires et al.
8,267,606 B2 9/2012 Delbove et al.
8,292,529 B2 10/2012 Francavilla
8,292,535 B2 10/2012 Thorpe
8,307,836 B2 11/2012 Pires et al.
8,360,674 B2 1/2013 Dwyer
8,517,622 B2 8/2013 Apodaca et al.
8,540,449 B2 9/2013 Song
D693,059 S 11/2013 Tani
8,573,874 B2 11/2013 Neuner
D696,816 S 12/2013 Kordulla et al.
8,662,089 B2 3/2014 Hwang
8,678,693 B2 3/2014 Sturgis et al.
8,864,401 B2 10/2014 Duru
8,881,745 B2 11/2014 Pires et al.
8,899,243 B2 12/2014 Pires et al.
9,016,968 B2 4/2015 Thorpe
2001/0037815 A1 11/2001 Gueret
2001/0047949 A1 12/2001 Bono
2002/0076258 A1 6/2002 Crosby et al.

(56) References Cited

U.S. PATENT DOCUMENTS

| | | | |
|---|---|---|---|
| 2002/0164192 | A1 | 11/2002 | Gueret |
| 2004/0018037 | A1 | 1/2004 | Gueret |
| 2004/0129284 | A1 | 7/2004 | Abergel |
| 2004/0190975 | A1 | 9/2004 | Goodman et al. |
| 2004/0222124 | A1 | 11/2004 | Byun |
| 2004/0237996 | A1 | 12/2004 | Fischer et al. |
| 2004/0249320 | A1 | 12/2004 | Yamazaki et al. |
| 2005/0000534 | A1 | 1/2005 | Tien |
| 2005/0031401 | A1 | 2/2005 | Gueret |
| 2005/0047848 | A1 | 3/2005 | Carraher |
| 2005/0175786 | A1 | 8/2005 | Singh et al. |
| 2005/0197268 | A1 | 9/2005 | Buskirk et al. |
| 2005/0249539 | A1 | 11/2005 | Habatjou |
| 2005/0258172 | A1 | 11/2005 | Gueret |
| 2006/0032512 | A1 | 2/2006 | Kress et al. |
| 2006/0039742 | A1 | 2/2006 | Cable et al. |
| 2006/0072956 | A1 | 4/2006 | Tanaka et al. |
| 2006/0093425 | A1 | 5/2006 | Gueret |
| 2006/0162736 | A1 | 7/2006 | Gray |
| 2006/0198686 | A1 | 9/2006 | Hetzel |
| 2006/0207627 | A1 | 9/2006 | Thorpe et al. |
| 2006/0216104 | A1 | 9/2006 | Bouix et al. |
| 2006/0272668 | A1 | 12/2006 | Wyatt et al. |
| 2006/0275072 | A1 | 12/2006 | Petit |
| 2007/0034224 | A1 | 2/2007 | Dumler |
| 2007/0071538 | A1 | 3/2007 | Doria |
| 2007/0084885 | A1 | 4/2007 | Conway et al. |
| 2007/0151571 | A1 | 7/2007 | Byun |
| 2007/0158372 | A1 | 7/2007 | Kurek et al. |
| 2007/0186950 | A1 | 8/2007 | Roeder |
| 2007/0186951 | A1 | 8/2007 | Gueret |
| 2007/0206986 | A1 | 9/2007 | Gueret |
| 2007/0272269 | A1 | 11/2007 | Wyatt et al. |
| 2007/0289602 | A1 | 12/2007 | Simmons |
| 2007/0297845 | A1 | 12/2007 | Gutberlet |
| 2008/0060665 | A1 | 3/2008 | Umeno et al. |
| 2008/0060668 | A1 | 3/2008 | LeGassie |
| 2008/0138138 | A1 | 6/2008 | Gueret |
| 2008/0166172 | A1 | 7/2008 | Eng et al. |
| 2008/0193193 | A1 | 8/2008 | Pechko et al. |
| 2008/0286030 | A1 | 11/2008 | Roder |
| 2009/0003917 | A1 | 1/2009 | Duncan |
| 2009/0071499 | A1 | 3/2009 | Wyatt et al. |
| 2009/0097899 | A1 | 4/2009 | Carroll |
| 2009/0194120 | A1 | 8/2009 | Pires et al. |
| 2009/0194127 | A1 | 8/2009 | Pires et al. |
| 2010/0028070 | A1 | 2/2010 | Gieux et al. |
| 2010/0059080 | A1 | 3/2010 | Gueret |
| 2010/0178095 | A1 | 7/2010 | Bouix et al. |
| 2010/0300474 | A1 | 12/2010 | Tsai |
| 2011/0056505 | A1 | 3/2011 | Parkinson et al. |
| 2011/0103878 | A1 | 5/2011 | Neuner et al. |
| 2011/0116857 | A1 | 5/2011 | Carroll et al. |
| 2011/0123248 | A1 | 5/2011 | Kim |
| 2011/0176856 | A1 | 7/2011 | Gardner et al. |
| 2011/0190672 | A1 | 8/2011 | Apodaca et al. |
| 2011/0250008 | A1 | 10/2011 | Lim |
| 2012/0014736 | A1 | 1/2012 | Pires et al. |
| 2012/0065555 | A1 | 3/2012 | Chae et al. |
| 2012/0204899 | A1 | 8/2012 | Uehara et al. |
| 2012/0266907 | A1 | 10/2012 | Chan |
| 2012/0282008 | A1 | 11/2012 | Geuther et al. |
| 2012/0312315 | A1 | 12/2012 | Gueret |
| 2013/0051894 | A1 | 2/2013 | Lim et al. |
| 2013/0121748 | A1 | 5/2013 | Ramirez |
| 2014/0219701 | A1 | 8/2014 | Eberlein |
| 2014/0234010 | A1 | 8/2014 | Thorpe et al. |

FOREIGN PATENT DOCUMENTS

| | | | |
|---|---|---|---|
| CN | 101884463 | A | 11/2010 |
| EP | 181184 | A2 | 5/1986 |
| EP | 1358818 | A1 | 11/2003 |
| EP | 2084986 | A2 | 8/2009 |
| EP | 1797848 | B1 | 3/2011 |
| GB | 798044 | A | 7/1958 |
| GB | 2262237 | A | 6/1993 |
| JP | 8238884 | A | 9/1996 |
| JP | 9056462 | A | 3/1997 |
| JP | 2000279870 | A | 10/2000 |
| JP | 2001190327 | A | 7/2001 |
| JP | 3808783 | B2 | 8/2006 |
| JP | 2006247037 | A | 9/2006 |
| KR | 20020039098 | A | 5/2002 |
| KR | 200383301 | Y1 | 4/2005 |
| KR | 200388116 | Y1 | 6/2005 |
| KR | 100523428 | B1 | 10/2005 |
| KR | 1020080067907 | A | 7/2008 |
| WO | 9211785 | A1 | 7/1992 |
| WO | 9531121 | A1 | 5/1995 |
| WO | 0210029 | A1 | 2/2002 |
| WO | 2005058405 | A1 | 6/2005 |
| WO | 2006031413 | A2 | 3/2006 |
| WO | 2007117091 | A1 | 10/2007 |
| WO | 2010098997 | A1 | 9/2010 |
| WO | 2011083427 | A2 | 7/2011 |
| WO | 2012032148 | A1 | 3/2012 |

OTHER PUBLICATIONS

Givenchy Demesure Audacious Lashes Mascara, May 17, 2011, retrieved from the Internet at www.fashionizers.com/perfumes-makeup/givenchu-demesure-auda- cious-lashes-mascara/, 9 pages.

* cited by examiner

WHEEL ACTUATED COSMETIC STICK

CROSS REFERENCE TO RELATED APPLICATIONS

The present application claims the benefit of and priority to U.S. Provisional Patent Application Ser. No. 62/642,744, filed on Mar. 14, 2018, titled WHEEL ACTUATED COSMETIC STICK, the disclosure of which is incorporated herein by reference.

BACKGROUND

Actuation of cosmetic stick products such as lipstick has conventionally been achieved by rotating the base relative to the container of product. Alternative designs for applicators are desired.

OVERVIEW

The present inventors have recognized, among other things, that a problem to be solved is a need for new and alternative designs for applicators for cosmetic stick products.

In a first non-limiting example, a cosmetic application device comprises a housing having an opening on a top surface thereof, an inner tube disposed within the housing and configured for holding a cosmetic stick, and a wheel actuator disposed on a side surface of the housing and rotatably coupled to the inner tube, the wheel actuator configured such that rotation of the wheel actuator causes the cosmetic stick to move axially through the housing and out of the opening.

Alternatively, or additionally, in another example, rotation of the wheel actuator causes the inner tube to rotate within the housing without moving axially along the housing.

Alternatively, or additionally, in another example, the wheel actuator includes a first gear and the inner tube includes a second gear mated with the first gear.

Alternatively, or additionally, in another example, the first and second gears are bevel miter gears.

Alternatively, or additionally, in another example, the cosmetic application device may further comprise a base insert and product holder, the base insert disposed within the housing and fixed against rotation relative to the housing, the base insert having an upper recess configured to receive a lower portion of the inner tube, the product holder defining a threaded shaft with a cup on an upper end thereof configured to receive a product stick.

Alternatively, or additionally, in another example, the base insert defines a channel at least an upper portion of which is threaded, the threading matching threading on the threaded shaft of the product holder such that rotation of the threaded shaft causes the threaded shaft to move axially relative to the base insert.

Alternatively, or additionally, in another example, the threaded shaft of the product holder has a non-circular cross section taken transverse to a longitudinal axis thereof and the inner tube has a non-circular opening in a bottom face thereof, the non-circular opening sized and shaped to match the non-circular cross section of the threaded shaft such that when the non-circular threaded shaft is disposed through the opening, rotation of the inner tube causes rotation of the threaded shaft, wherein the cup of the product holder is disposed within the inner tube with the threaded shaft extending downward through the non-circular opening and into the channel of the base insert, wherein vertical rotation of the wheel actuator causes horizontal rotation of the inner tube relative to the housing and base insert, which rotates the threaded shaft of the product holder, rotation of the threaded shaft against the threading on the channel of the base insert causes the product holder to move axially relative to the housing, moving the product stick out of or back into the opening in the top surface of the housing.

Alternatively, or additionally, in another example, the non-circular opening and non-circular cross section are rectangular.

Alternatively, or additionally, in another example, the cosmetic application device further comprises a cap configured to be removably disposed over the top surface of the housing, the cap having a locking member configured to prevent the wheel actuator from being rotated when the cap is disposed on the housing.

Alternatively, or additionally, in another example, the wheel actuator includes a plurality of grooves on a circumferential outer surface thereof and the locking member includes at least one extension configured to engage at least one of the plurality of grooves on the wheel actuator, thereby preventing the wheel actuator from being rotated when the cap is disposed on the housing.

Alternatively, or additionally, in another example, the cosmetic application device further comprises a product stick disposed within the housing, the product stick selected from the group consisting of lipstick, lip liner, lip balm, eyeliner, eye shadow, eyebrow pencil, concealer, foundation, blush, deodorant, and sunscreen.

Alternatively, or additionally, in another example, the wheel actuator is positioned adjacent a lower end of the housing, opposite the top surface.

Alternatively, or additionally, in another example, the wheel actuator is positioned closer to the top surface of the housing than to a lower end of the housing.

According to another example, a device for dispensing and applying a cosmetic product comprises a housing configured to hold a cosmetic product stick, the housing comprising an open top end and a passageway extending longitudinally from the open top end to a closed bottom end, a base insert fixedly disposed within the passageway adjacent the closed bottom end, the base insert having a channel that is at least partially threaded, a product holder having a threaded shaft rotatably disposed with in the channel of the base insert, the product holder having a cup configured to receive the cosmetic product stick, an inner tube having a bottom end face disposed within an upper portion of the channel of the base insert, the inner tube rotatable relative to the base insert, the bottom end face having an opening configured to receive the threaded shaft of the product holder such that the threaded shaft of the product holder rotates with the inner tube, the inner tube, and a wheel actuator rotatably connected to a side of the inner tube such that rotation of the wheel actuator causes rotation of the inner tube, thereby rotating the product holder and moving the product holder axially within the housing.

Alternatively, or additionally, in another example, the inner tube includes a first gear rotatably engaged with a second gear on the wheel actuator.

Alternatively, or additionally, in another example, the first gear is a bevel gear disposed circumferentially around an outer surface of the inner tube and the second gear is a bevel gear disposed within the wheel actuator.

Alternatively, or additionally, in another example, the device further comprises a cap configured to be removably disposed over the open top end of the housing, the cap having a locking member configured to prevent the wheel actuator from being rotated when the cap is disposed on the housing.

Alternatively, or additionally, in another example, the wheel actuator includes a plurality of grooves on a circumferential outer surface thereof and the locking member includes at least one extension configured to engage at least one of the plurality of grooves on the wheel actuator, thereby preventing the wheel actuator from being rotated when the cap is disposed on the housing.

Alternatively, or additionally, in another example, the device further comprises a product stick having a bottom end disposed within the cup of the product holder, the product stick moveable along the passageway of the housing and out of the open top end, the product stick selected from the group consisting of lipstick, lip liner, lip balm, eyeliner, eye shadow, eyebrow pencil, concealer, foundation, and blush.

According to another example, a method of dispensing a cosmetic product stick comprises rotating a vertical wheel actuator disposed on a side surface of an housing in a first direction, the housing having an inner tube disposed therein, the inner tube holding a cosmetic product stick and being rotatably coupled to the vertical wheel actuator, and rotating the inner tube horizontally within the housing, thereby advancing the cosmetic product stick out an opening in a top surface of the housing.

The above summary of some example embodiments is not intended to describe each disclosed embodiment or every implementation of the present disclosure. The Figures, and Detailed Description, which follow, more particularly exemplify these embodiments.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Conventional cosmetic stick product applicators, such as lipstick, typically take the form of an elongated housing with a base horizontally rotatable relative to an upper portion containing the product. The lipstick is extended out of the housing as the base is rotated in a first direction and retracted as the base is rotated in a second, opposite direction. The bottom end of the lipstick may be held in a cup that rotates in the same direction as the base. Some of these lipstick applicators may be operated one-handed, although such manipulation is often awkward and/or difficult. The present inventors have identified a new and different cosmetic application device in which a product stick is extended and retracted by rotation of a wheel located on the side of the housing. This device may allow for easier one-handed use of the applicator.

Figure 1:
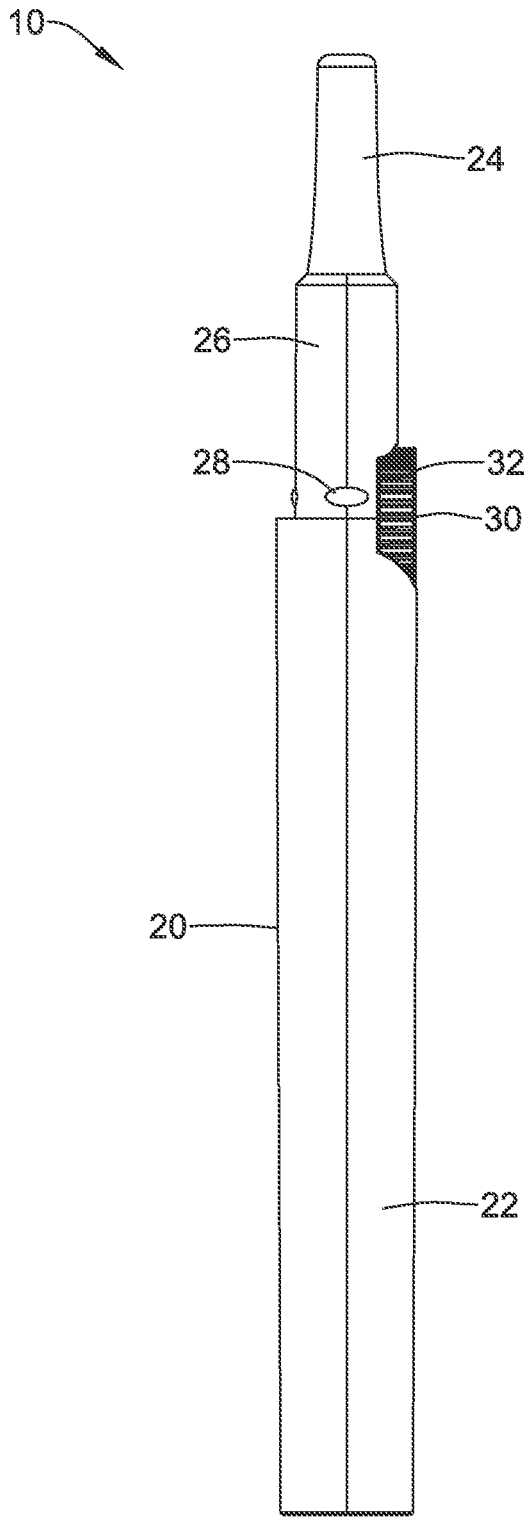
FIG. 1 is a side view of an illustrative cosmetic stick with the cap removed.

FIG. 1 shows an illustrative cosmetic application device configured to apply a product in a solid or semi-solid stick form. The cosmetic application device may be used to apply a cosmetic product to the face or other parts of the body. The cosmetic application device may be used with cosmetic product sticks such as lipstick, lip liner, lip balm, eyeliner, eye shadow, eyebrow pencil, concealer, foundation, blush, deodorant, sunscreen or any other cosmetic or personal care product formulated as a solid or semi-solid stick.

Figure 2:
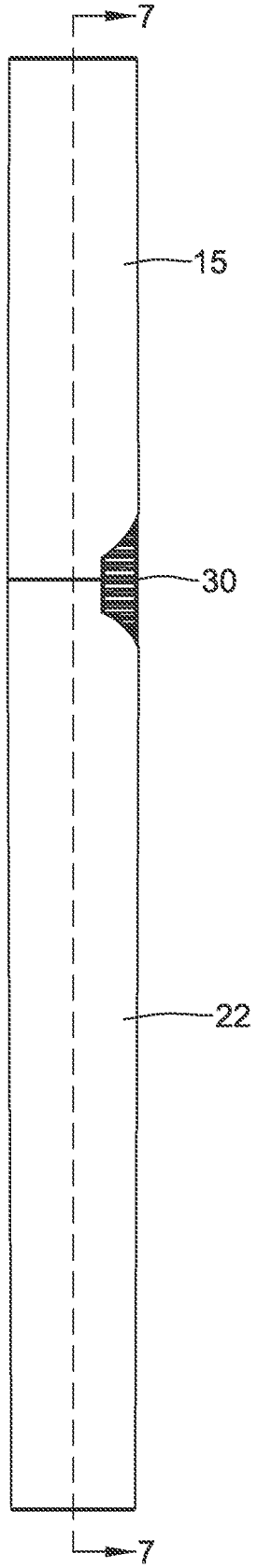
FIG. 2 is a side view of the cosmetic stick of FIG. 1, with the cap attached.

The cosmetic application device 10 shown in FIG. 1 includes a housing 20 and a wheel actuator 30. The housing 20 may include a base 22, collar 26, and neck 24, which may be formed as separate pieces fixed together or as a single monolithic piece. The collar 26 may include one or more protrusions 28 configured to engage a cap. The wheel actuator 30 may be rotatably attached to the side of the housing 20 and may include one or more grooves 32 that may provide a roughened surface to aid in manually turning the wheel actuator 30. Due to the position of the wheel actuator 30 on the side of the housing 20, the wheel actuator 30 is rotated vertically. This is different from conventional lipsticks where the base is rotated horizontally. In some examples, the collar 26 may have a smaller outer diameter than the base 22, as illustrated in FIG. 1, such that when the wheel actuator 30 is attached to the collar 26 and a cap 15 is disposed over the collar 26 and neck 24, the outer diameter of the housing at the base 22, cap 15, and wheel actuator 30 is substantially the same, as shown in FIG. 2.

Figure 3:
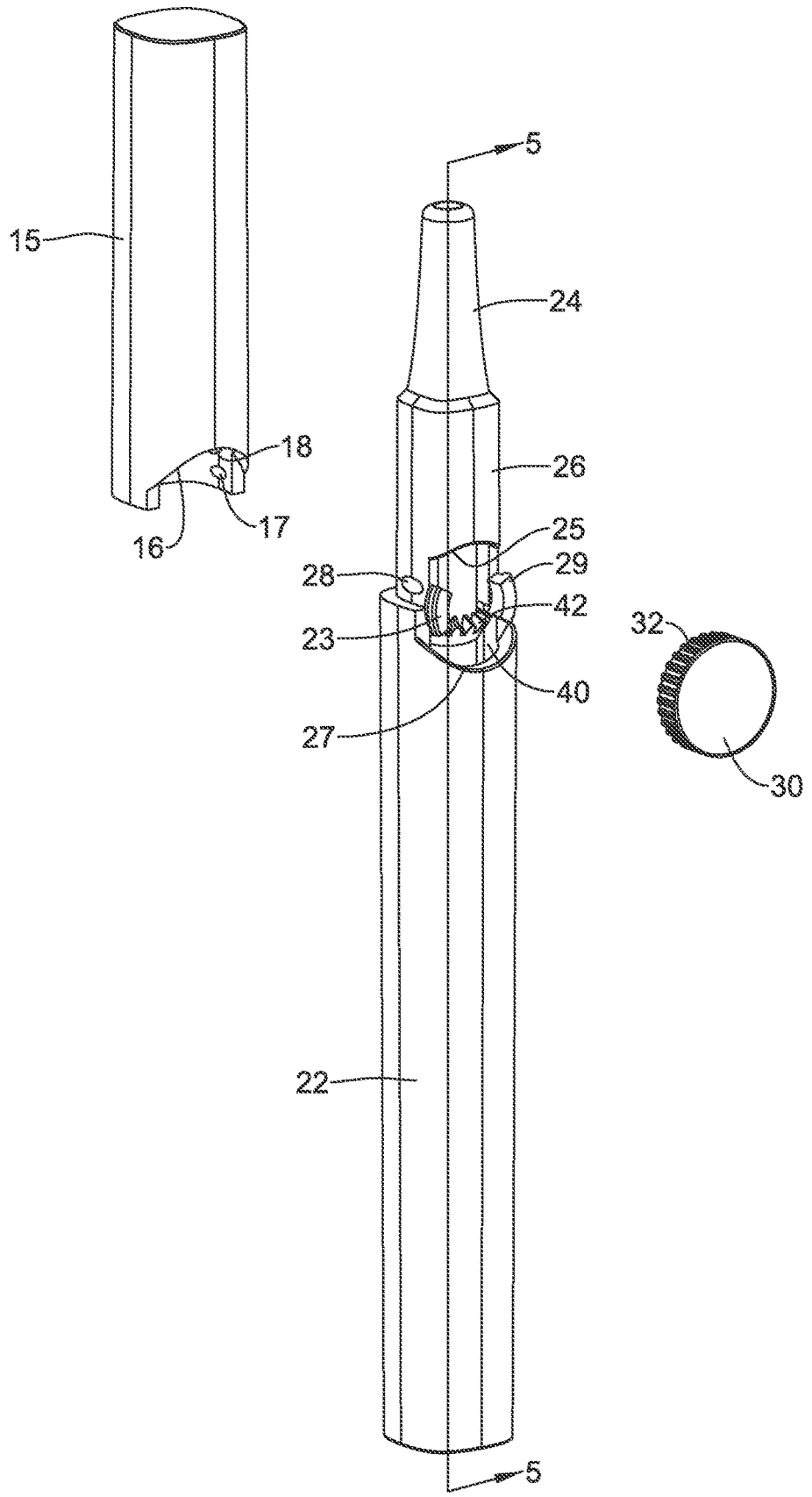
FIG. 3 is a perspective view of the cosmetic stick of FIG. 2 with the cap and wheel separated from the housing.

The cap 15 may have a cutout 16 sized and shaped to receive an upper portion of the wheel actuator 30, as shown in FIG. 3. The inner surface of the cap 15 may include one or more recesses 17 sized and shaped to receive the protrusions 28 on the collar 26 of the housing 20 to aid in securing the cap 15 to the housing 20. The cap 15 may have a locking feature to prevent rotation of the wheel actuator 30 when the cap 15 is disposed on the housing 20. This would prevent the cosmetic product stick 50 from inadvertently being pushed up against the inside of the cap 15 and breaking or smashing the cosmetic product. In some examples, the locking feature may include one or more extension 18 on a surface of the cutout 16 of the cap 15. The extension 18 may mate with the grooves 32 on the wheel actuator 30, thereby preventing rotation of the wheel actuator 30 when the cap 15 is disposed on the housing 20.

Figure 4:
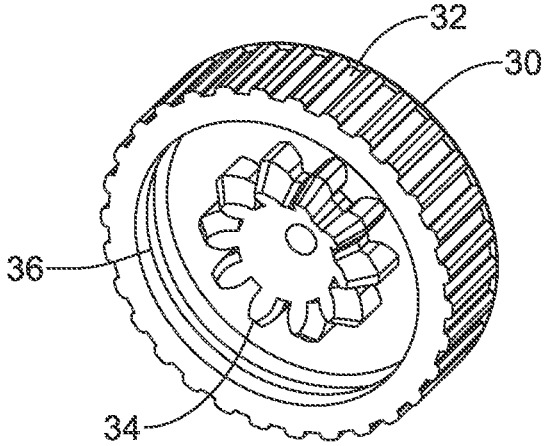
FIG. 4 is a perspective rear view of a wheel actuator of the cosmetic stick of FIG. 1.

The housing 20 may have an upper cutout 25 in the collar 26 and a lower cutout 27 in the base 22 wherein the two cutouts combine to define an opening sized to receive the wheel actuator 30. The cutouts 25, 27 may provide access to a passageway 19 extending longitudinally through the housing 20. The housing 20 may include one or more extensions 23 configured to secure the wheel actuator 30 to the housing 20 while allowing rotation of the wheel actuator 30. In some examples, the extensions 23 may have an outwardly extending flange 29 configured to engage a groove 36 extending circumferentially around an inner surface of the wheel actuator, as shown in FIG. 4. The wheel actuator 30 may include a first gear 34 configured to mate with a second gear 42 on an inner tube 40 disposed within the housing 20. As shown in FIG. 3, the inner tube 40 is disposed within the housing 20 such that the second gear 42 is accessible through the opening defined by the upper cutout 25 and lower cutout 27 in the housing 20.

Figure 5:
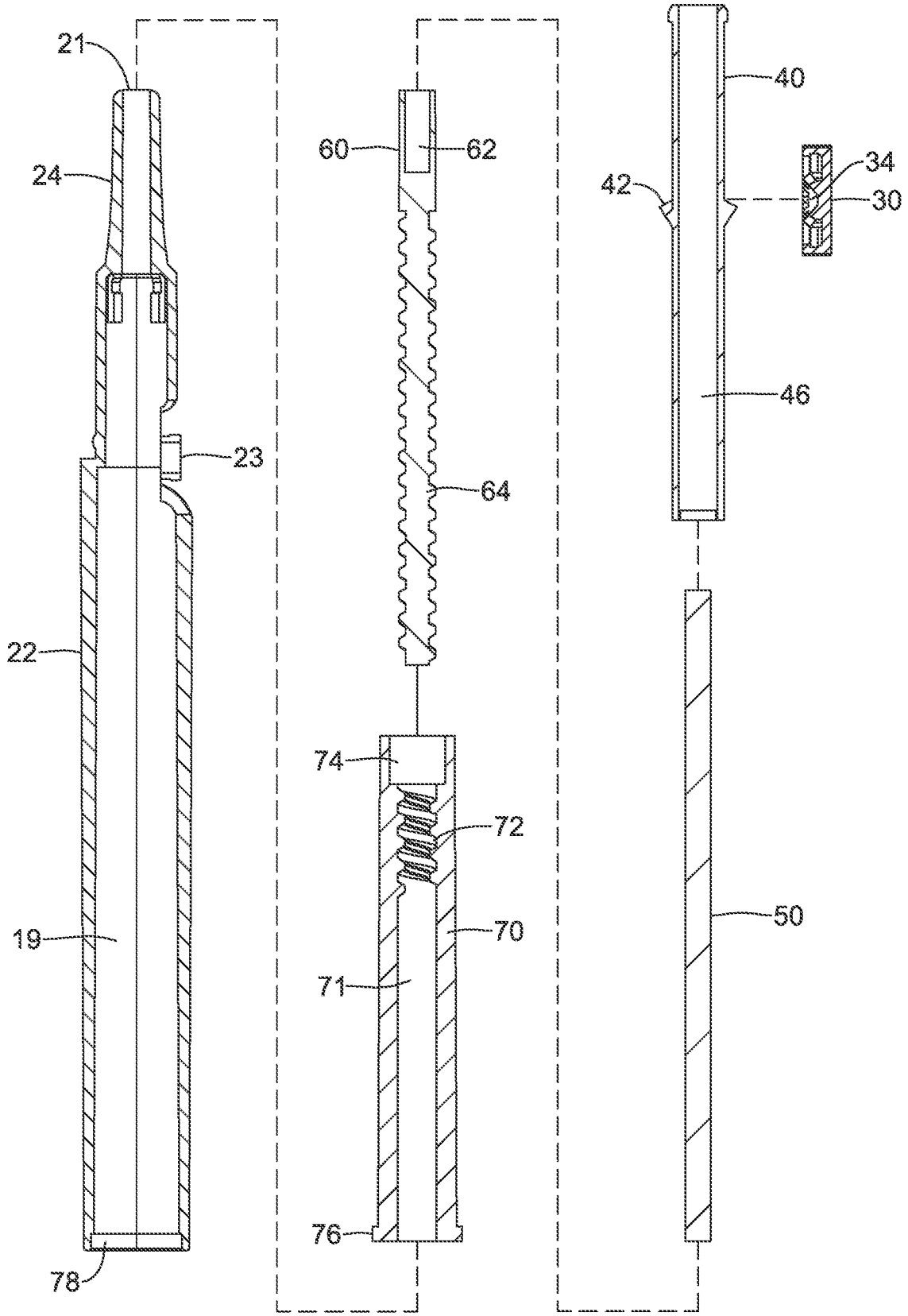
FIG. 5 is a cross-sectional exploded view of the cosmetic stick of FIG. 1, taken along line 5-5 in FIG. 3.

As shown in FIG. 5, the housing 20 may contain a base insert 70, a product holder 60, a cosmetic product stick 50, and the inner tube 40 within the passageway 19. The passageway 19 may extend through the entire housing 20, from a closed bottom end to an opening 21 in the top end. The passageway 19 in the neck 24 portion of the housing is sized to receive the product stick 50, which may be extended and retracted through the opening 21.

The base insert 70 is configured to be disposed within the base 22 portion of the housing 20 and is fixed against rotation and axial movement relative to the housing. In some examples, the base insert 70 may have a lower lateral extension 76 which may be received in a recess 78 in the bottom of the housing. The lateral extension 76 and recess 78 may have non-round shapes, preventing rotation of the base insert 70 even if the base insert 70 has an outer cylindrical shape. The base insert 70 may have a channel 71 extending longitudinally therethrough, with at least a portion of the channel 71 having internal threading 72. The base insert 70 may include an upper recess 74 configured to receive the lower portion of the inner tube 40. The inner tube 40 is configured to rotate within the recess 74.

A product holder 60 may have a threaded shaft 64 configured to be received within the channel 71 of the base insert 70, where threading on the shaft 64 is configured to engage the threading 72 in the channel 71. In other examples, the threading 72 may be replaced by two protrusions extending into the channel 71 and configured to engage the threaded shaft 64. The product holder 60 may also have a cup 62 at a top end thereof sized and configured to receive a lower end of the cosmetic product stick 50. The cosmetic product stick 50 may be coupled to the cup 62 by a friction fit, adhesive, crimping element, or any other conventional means of coupling a cosmetic product stick to a holder.

The inner tube 40 may have a channel 46 configured to receive the product holder 60 and the cosmetic product stick 50. As shown in FIG. 5, the first gear 34 on the wheel actuator 30 and the second gear 42 on the inner tube 40 may have axes at right angles. The first and second gears 34, 42 may be bevel gears. In some examples, the first and second gears 34, 42 may be miter gears with equal numbers of teeth and with axes at right angles. The first and second gears 34, 42 may be formed as miter gears in examples where it is desired for the wheel actuator 30 to transmit rotational motion at a 90 degree angle with a 1:1 ration to the inner tube 40. Alternatively, the first and second gears 34, 42 may have axes at less than or more than 90 degrees and differing number of teeth, allowing for a change in the ratio of rotations between the two gears. Altering the ratio may allow for relatively little rotation of the wheel actuator 30 to result in greater axial movement of the product stick 50, or for a relatively large rotation of the wheel actuator 30 to result in less axial movement of the product stick 50. The geometry of the first and second gears 34, 42 may be that of straight bevel gears, spiral bevel gears, zero bevel gears, or hypoid bevel gears.

Figure 6:
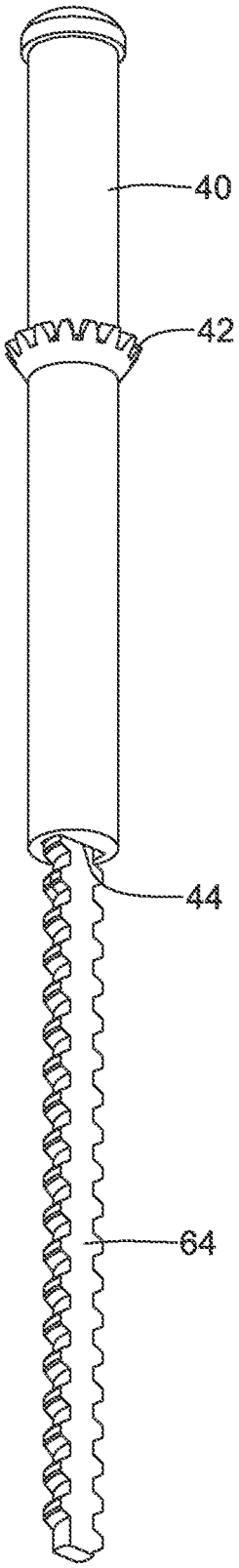
FIG. 6 is a perspective view showing the interaction of an inner tube and product holder of the cosmetic stick of FIG. 1.

Details of the interaction between the inner tube 40 and the product holder threaded shaft 64 are illustrated in FIG. 6. FIG. 6 also illustrates the second gear 42 extending around the outer circumference of the inner tube 40. The second gear 42 is shown as a bevel gear. The inner tube 40 has a bottom opening 44 with a non-round shape matching the non-round shape of the threaded shaft 64. The non-round shapes of the opening 44 and threaded shaft 64 result in the threaded shaft 64 rotating with the inner tube 40, while allowing the threaded shaft 64 to move axially into and out of the opening 44. In the example shown in FIG. 6, the threaded shaft 64 has a rectangular cross section that matches the rectangular opening 44. The rectangular threaded shaft 64 may be threaded on the short sides of the rectangle and have substantially smooth flat long sides. As shown in the front and side cross sectional views of FIGS. 7 and 8, respectively, the threaded sides of the rectangular threaded shaft 64 engage the internal threading 72 on the base insert 70.

Figure 7:
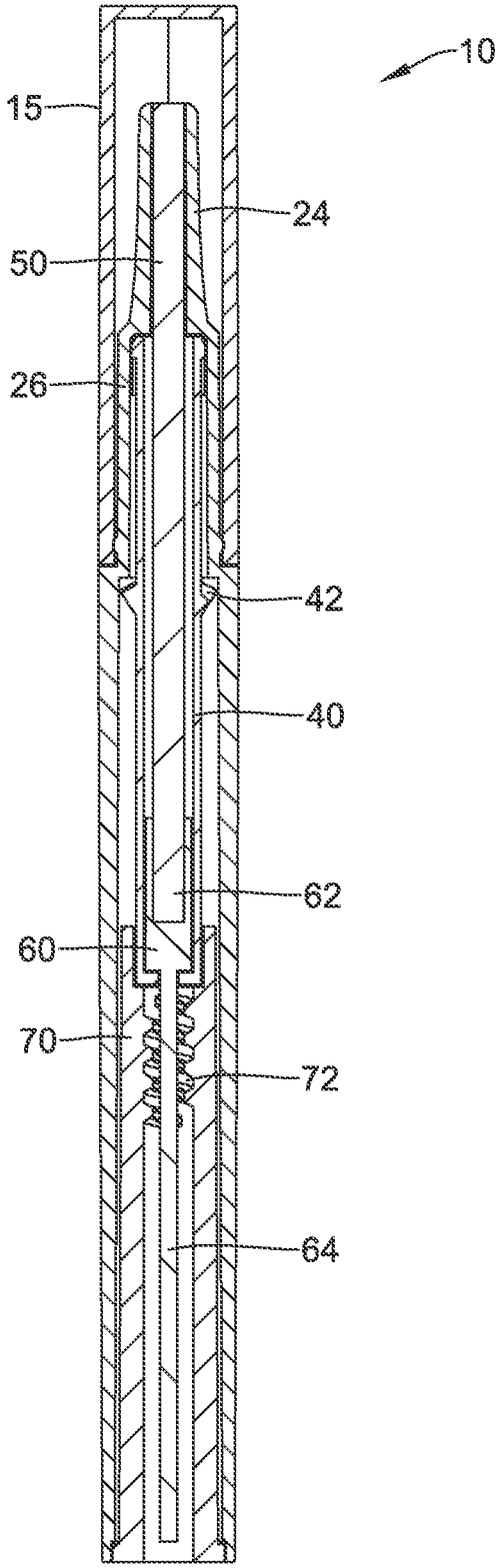
FIG. 7 is a front cross sectional view taken along line 7-7 in FIG. 2.

FIG. 7 shows the cosmetic application device 10 with the product stick 50 in the fully retracted orientation and the cap 15 on. After removing the cap 15, the user may extend the product stick 50 through the opening 21 in the housing 20 by rotating the wheel actuator 30 vertically in a first direction. In general, rotating the wheel actuator 30 in the first direction will extend the product stick 50 out of the housing 20 and rotating the wheel actuator 30 in a second direction opposite the first direction will retract the product stick 50 back into the housing 20. In some examples, the first direction may be clockwise. Alternatively, the first direction may be counter-clockwise.

Figure 8:
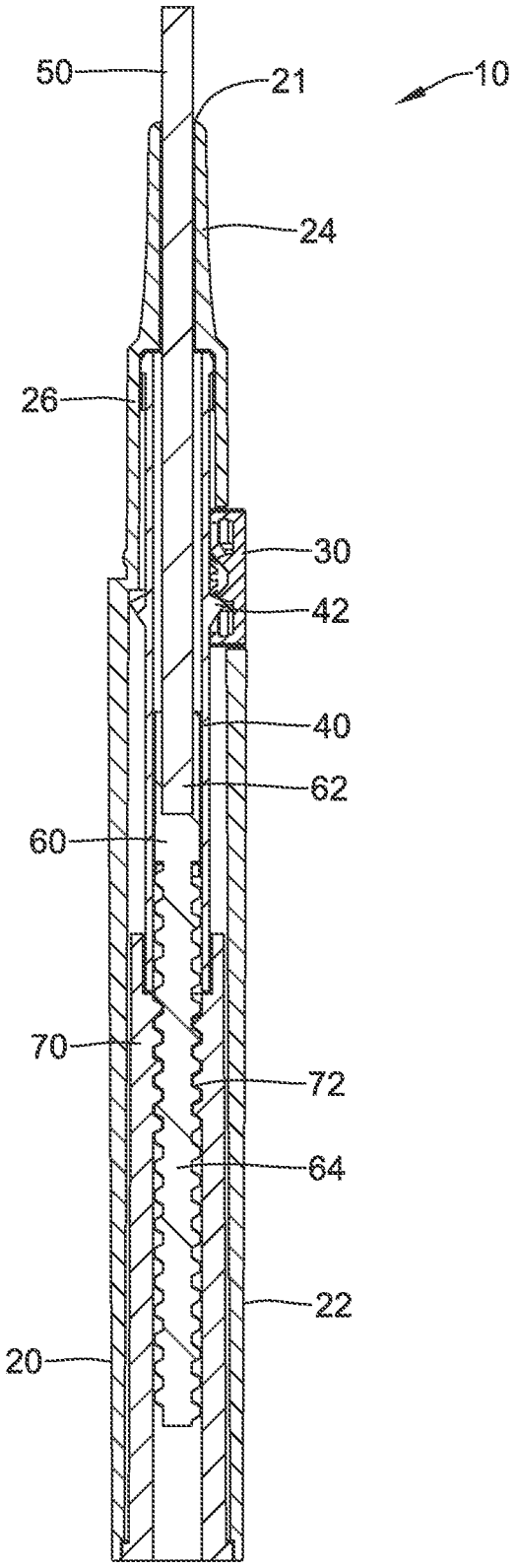
FIG. 8 is a side cross sectional view taken along line 5-5 in FIG. 3 with the product stick extended.

Vertical rotation of the wheel actuator 30 in a first direction will result in horizontal rotation of the inner tube 40 in the first direction due to the interaction of the first gear 34 on the wheel actuator 30 turning the second gear 42 on the inner tube 40. The inner tube 40 rotates within the housing 20 but does not move axially within the housing. Rotation of the inner tube 40 causes rotation of the product holder 60 and its threaded shaft 64. Rotation of the threaded shaft 64 against the threading 72 on the base insert 70 causes the threaded shaft 64 and product holder 60 to move axially within the base insert 70, thereby moving the attached product stick 50 axially within the inner tube 40 and housing 20. FIG. 8 shows the cosmetic application device 10 with a portion of the product stick 50 moved axially out of the opening 21 in the housing 20. Once the product has been applied, the wheel actuator 30 may be rotated in the second direction, opposite the first direction, to retract the product stick 50 back into the housing 20. The cap 15 may then be placed over the neck 24 and collar 26 of the housing, with the extension 18 on the cap 15 engaging the grooves 32 on the wheel actuator 30, preventing rotation of the wheel actuator 30 while the cap 15 is on the housing 20.

The housing 20, cap 15, wheel actuator, inner tube 40, product holder 60, and base insert 70 as shown and described above may be made of any suitable material such as, for example, thermoplastic elastomer (TPE), low density polyethylene (LDPE), synthetic polymer, partially of a resin such as, for example, acrylonitrile butadiene styrene (ABS), styrene acrylonitrile (SAN), pentachlorothioanisole (PCTA), polypropylene (PP), polyethylene (PE), polyurethane, rubber, silicone, nylon, ceramic, glass, metal, or composite material, and/or combinations thereof. Moreover, various elements may be made of any combination of substantially clear, substantially opaque, and/or translucent materials. Natural materials as wood, stone or leather may be used as well for decorative or other purposes.

For the following defined terms, these definitions shall be applied, unless a different definition is given in the claims or elsewhere in this specification. In this document, the terms "a" or "an" are used, as is common in patent documents, to include one or more than one, independent of any other instances or usages of "at least one" or "one or more" unless the content clearly dictates otherwise. Moreover, in the following claims, the terms "first," "second," and "third," etc. are used merely as labels, and are not intended to impose numerical requirements on their objects. The above description is intended to be illustrative, and not restrictive.

As used in the above description and the appended claims, the term "or" is generally employed in its sense including "and/or" unless the content clearly dictates otherwise.

Relative terms such as "front", "back", "side", "top", "bottom", variants thereof, and the like, may be generally be considered with respect to the positioning, direction, and/or operation of various elements relative to a user and/or other components of the device. It is to be understood that relative terms are not intended to be limiting and are only exemplary.

The above detailed description should be read with reference to the drawings in which similar elements in different drawings are numbered the same. The drawings, which are not necessarily to scale, show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein. For example, the above examples (or one or more aspects thereof) may be used in combination with each other. Other embodiments can be used, such as by one of ordinary skill in the art upon reviewing the above description.

Although the invention has been described in language specific to structural features and/or methodological acts, it is to be understood that the invention is not necessarily limited to the specific features or acts described. Rather, the specific features and acts are disclosed as illustrative forms of implementing the invention.

What is claimed is:

1. A cosmetic application device comprising:

a housing having an opening on a top surface thereof;

an inner tube disposed within the housing and configured for holding a cosmetic stick;

a wheel actuator disposed on a side surface of the housing and rotatably coupled to the inner tube, the wheel actuator configured such that rotation of the wheel actuator causes the cosmetic stick to move axially through the housing and out of the opening;

a base insert having an upper recess configured to receive a lower portion of the inner tube, the base insert disposed within the housing and fixed against rotation relative to the housing; and a product holder having a threaded shaft with a cup on an upper end thereof configured to receive a product stick.

2. The cosmetic application device of claim 1, wherein rotation of the wheel actuator causes the inner tube to rotate within the housing without moving axially along the housing.

3. The cosmetic application device of claim 2, wherein the wheel actuator includes a first gear and the inner tube includes a second gear mated with the first gear.

4. The cosmetic application device of claim 3, wherein the first and second gears are bevel miter gears.

5. The cosmetic application device of claim 1, wherein the base insert defines a channel at least an upper portion of which is threaded, the threading matching threading on the threaded shaft of the product holder such that rotation of the threaded shaft causes the threaded shaft to move axially relative to the base insert.

6. The cosmetic application device of claim 5, wherein the threaded shaft of the product holder has a non-circular cross section taken transverse to a longitudinal axis thereof and the inner tube has a non-circular opening in a bottom face thereof, the non-circular opening sized and shaped to match the non-circular cross section of the threaded shaft such that when the non-circular threaded shaft is disposed through the non-circular opening, rotation of the inner tube causes rotation of the threaded shaft, wherein the cup of the product holder is disposed within the inner tube with the threaded shaft extending downward through the non-circular opening and into the channel of the base insert, wherein vertical rotation of the wheel actuator causes horizontal rotation of the inner tube relative to the housing and base insert, which rotates the threaded shaft of the product holder, rotation of the threaded shaft against the threading on the channel of the base insert causes the product holder to move axially relative to the housing, moving the product stick out of or back into the opening in the top surface of the housing.

7. The cosmetic application device of claim 6, wherein the non-circular opening and non-circular cross section are rectangular.

8. The cosmetic application device of claim 1, further comprising a product stick disposed within the housing, the product stick selected from the group consisting of lipstick, lip liner, lip balm, eyeliner, eye shadow, eyebrow pencil, concealer, foundation, blush, deodorant, and sunscreen.

9. The cosmetic application device of claim 1, wherein the wheel actuator is positioned adjacent a lower end of the housing, opposite the top surface.

10. The cosmetic application device of claim 1, wherein the wheel actuator is positioned closer to the top surface of the housing than to a lower end of the housing.

11. A cosmetic application device comprising:

a housing having an opening on a top surface thereof;

an inner tube disposed within the housing and configured for holding a cosmetic stick;

a wheel actuator disposed on a side surface of the housing and rotatably coupled to the inner tube, the wheel actuator configured such that rotation of the wheel actuator causes the cosmetic stick to move axially through the housing and out of the opening; and a cap configured to be removably disposed over the top surface of the housing, the cap having a locking member configured to prevent the wheel actuator from being rotated when the cap is disposed on the housing.

12. The cosmetic application device of claim 11, wherein the wheel actuator includes a plurality of grooves on a circumferential outer surface thereof and the locking member includes at least one extension configured to engage at least one of the plurality of grooves on the wheel actuator, thereby preventing the wheel actuator from being rotated when the cap is disposed on the housing.

13. The cosmetic application device of claim 11, further comprising a base insert and product holder, the base insert disposed within the housing and fixed against rotation relative to the housing, the base insert having an upper recess configured to receive a lower portion of the inner tube, the product holder defining a threaded shaft with a cup on an upper end thereof configured to receive a product stick.

14. The cosmetic application device of claim 13, wherein the base insert defines a channel at least an upper portion of which is threaded, the threading matching threading on the threaded shaft of the product holder such that rotation of the threaded shaft causes the threaded shaft to move axially relative to the base insert.

15. A device for dispensing and applying a cosmetic product, the device comprising:

a housing configured to hold a cosmetic product stick, the housing comprising an open top end and a passageway extending longitudinally from the open top end to a closed bottom end;

a base insert fixedly disposed within the passageway adjacent the closed bottom end, the base insert having a channel that is at least partially threaded;

a product holder having a threaded shaft rotatably disposed with in the channel of the base insert, the product holder having a cup configured to receive the cosmetic product stick;

an inner tube having a bottom end face disposed within an upper portion of the channel of the base insert, the inner tube rotatable relative to the base insert, the bottom end face having an opening configured to receive the threaded shaft of the product holder such that the threaded shaft of the product holder rotates with the inner tube; and a wheel actuator rotatably connected to a side of the inner tube such that rotation of the wheel actuator causes rotation of the inner tube, thereby rotating the product holder and moving the product holder axially within the housing.

16. The device of claim 15, wherein the inner tube includes a first gear rotatably engaged with a second gear on the wheel actuator.

17. The device of claim 16, wherein the first gear is a bevel gear disposed circumferentially around an outer surface of the inner tube and the second gear is a bevel gear disposed within the wheel actuator.

18. The device of any claim 15, further comprising a cap configured to be removably disposed over the open top end of the housing, the cap having a locking member configured to prevent the wheel actuator from being rotated when the cap is disposed on the housing.

19. The device of claim 18, wherein the wheel actuator includes a plurality of grooves on a circumferential outer surface thereof and the locking member includes at least one extension configured to engage at least one of the plurality of grooves on the wheel actuator, thereby preventing the wheel actuator from being rotated when the cap is disposed on the housing.

20. The device of claim 15, further comprising a product stick having a bottom end disposed within the cup of the product holder, the product stick moveable along the passageway of the housing and out of the open top end, the product stick selected from the group consisting of lipstick, lip liner, lip balm, eyeliner, eye shadow, eyebrow pencil, concealer, foundation, and blush.

* * * * *